US010800068B2

(12) United States Patent
Prentiss

(10) Patent No.: US 10,800,068 B2
(45) Date of Patent: Oct. 13, 2020

(54) LOG SPLITTING ARTICLE AND METHOD FOR IMPLEMENTING SAME

(71) Applicant: Lance R. Prentiss, Colchester, CT (US)

(72) Inventor: Lance R. Prentiss, Colchester, CT (US)

( * ) Notice: Subject to any disclaimer, the term of this patent is extended or adjusted under 35 U.S.C. 154(b) by 0 days.

(21) Appl. No.: 14/701,939

(22) Filed: May 1, 2015

(65) Prior Publication Data

US 2015/0314472 A1 Nov. 5, 2015

Related U.S. Application Data

(60) Provisional application No. 61/986,953, filed on May 1, 2014.

(51) Int. Cl.
*B27L 7/00* (2006.01)
*B27L 7/06* (2006.01)

(52) U.S. Cl.
CPC .. *B27L 7/00* (2013.01); *B27L 7/06* (2013.01)

(58) Field of Classification Search
CPC ..... B27L 7/00; B27L 7/02; B27L 7/06; B27L 7/08
USPC ..... 144/195.1
See application file for complete search history.

(56) References Cited

U.S. PATENT DOCUMENTS 3,319,675 A * 5/1967 Bles, Sr. ..... B27L 7/00 144/193.1
4,061,168 A * 12/1977 Fariss, Jr. ..... B27L 7/00 144/193.1
4,239,070 A * 12/1980 Burns ..... B27L 7/00 144/195.1
4,353,401 A * 10/1982 Schilling ..... B27L 7/00 144/193.2
4,416,313 A * 11/1983 Seeger ..... B27L 7/00 144/193.1
4,423,759 A * 1/1984 Seeger ..... B27L 7/00 144/193.1
4,428,409 A * 1/1984 Roetzler ..... B27L 7/06 144/195.1
4,453,580 A * 6/1984 Patten ..... B27L 7/00 144/195.1
4,461,331 A * 7/1984 Mertz ..... B27L 7/00 144/195.1
4,470,441 A * 9/1984 Wirsbinski ..... B27L 7/00 144/195.1
4,646,799 A * 3/1987 Cobb ..... B23D 15/145 144/195.3
4,679,607 A * 7/1987 Bradley ..... B27L 7/06 144/195.1

(Continued)

*Primary Examiner* — Shelley M Self
*Assistant Examiner* — Smith Oberto Bapthelus
(74) *Attorney, Agent, or Firm* — Michael A. Blake

(57) ABSTRACT

A log splitter is provided, wherein the log splitter includes a splitter housing, wherein the splitter housing defines a housing cavity, a splitter head, wherein the splitter head includes a splitter blade, a splitter butt plate and a splitter hydraulic cylinder, wherein the splitter head and splitter butt plate are configured to define a log cavity between the splitter blade and the splitter butt plate and wherein the splitter head is movably associated with the splitter housing and connected to the splitter hydraulic cylinder, such that the splitter head is movable along the length of the splitter housing.

8 Claims, 18 Drawing Sheets

(56) References Cited

U.S. PATENT DOCUMENTS 4,782,866 A * 11/1988 Valdez ..... B27L 7/06 144/195.1
4,800,937 A * 1/1989 Mangus, Sr. ..... B27L 7/06 144/190
4,804,031 A * 2/1989 Rouse ..... B60C 25/0524 157/1.21
4,842,030 A * 6/1989 Meyer ..... B27L 7/00 144/195.1
4,945,960 A * 8/1990 McCauley ..... B27L 7/00 144/195.1
5,921,300 A * 7/1999 Smith ..... B27L 7/00 144/193.1
6,520,226 B1 * 2/2003 Smith ..... B27L 7/00 144/193.1
6,640,852 B1 * 11/2003 Rogers ..... B27L 7/00 144/195.1
7,011,123 B2 * 3/2006 Peterson ..... B27L 7/00 144/193.1
7,108,029 B2 * 9/2006 Albright ..... B27L 7/06 144/193.2
7,124,794 B2 * 10/2006 Marx ..... B27L 7/00 144/193.2
7,198,081 B2 * 4/2007 Lewis ..... B27L 7/00 144/195.8
7,255,143 B1 * 8/2007 Babcock ..... B27L 7/06 144/193.1
7,814,945 B2 * 10/2010 Babcock ..... B27L 7/00 144/193.2
9,266,252 B1 * 2/2016 Panos ..... B27L 7/00
2003/0155037 A1 * 8/2003 Alexander ..... B27L 7/00 144/195.1
2003/0230360 A1 * 12/2003 Setlack ..... B27L 7/00 144/195.1
2004/0250895 A1 * 12/2004 Marx ..... B27L 7/00 144/193.1
2005/0284542 A1 * 12/2005 Stone ..... B27L 7/00 144/195.8
2006/0144468 A1 * 7/2006 Lewis ..... B27L 7/00 144/193.2
2008/0251158 A1 * 10/2008 Koch ..... B27L 7/00 144/366
2009/0050237 A1 * 2/2009 Windrich ..... B27L 7/00 144/195.1
2009/0229709 A1 * 9/2009 Babcock ..... B27L 7/00 144/195.1
2009/0242078 A1 * 10/2009 Schamberger ..... B27L 7/00 144/195.1
2011/0041955 A1 * 2/2011 Bedel ..... B27L 7/00 144/195.1
2011/0048581 A1 * 3/2011 Hicks ..... B27L 7/06 144/195.8
2012/0073704 A1 * 3/2012 Larrabee ..... B27L 7/00 144/195.1
2012/0255650 A1 * 10/2012 Fields ..... B27G 1/00 144/366
2013/0000785 A1 * 1/2013 Banjo ..... B27L 7/00 144/366
2014/0124097 A1 * 5/2014 Banjo ..... B27L 7/06 144/193.1
2015/0314472 A1 * 11/2015 Prentiss ..... B27L 7/00 144/195.1

* cited by examiner

Section A-A

Section A-A

Section B-B

LOG SPLITTING ARTICLE AND METHOD FOR IMPLEMENTING SAME

RELATED APPLICATIONS

This application claims the benefit of priority of the filing date of U.S. Provisional Patent Application Ser. No. 61/986,953 filed May 1, 2014, the contents of which is incorporated herein by reference in its entirety.

FIELD OF THE INVENTION

This invention relates generally to the logging industry and more particularly to an article and method for splitting logs.

BACKGROUND OF THE INVENTION

As the economy remains stagnant and unemployment remains high for the middleclass, people are becoming more and more financially strapped for cash. As a result, there is a drive to save money on every day bills. This means cutting out certain luxuries and finding ways to conserve and/or reduce costs on the things that are necessary to survive. One of the largest costs to the average consumer is heating the home, where this cost can vary greatly depending on the type of heating source used in the particular home. This cost variation is caused in large part due to the varying nature of fossil fuel prices. In order to hedge these variations and reduce fuel costs, many people use wood stoves or wood burning fireplaces to help heat the home. This is advantageous because wood is a local renewable resource that is readily available to the average person.

Typically, when a tree is cut down, the length of the tree trunk is cut into smaller sized cylindrical pieces of wood that are about 1½ to 2½ feet long. These smaller pieces of wood are then split into multiple 'wedges' of wood that are sized to fit into a wood stove or a fireplace. This process is a laborious, sometimes dangerous and time consuming task. This is because the trees are felled and cut into smaller cylindrical pieces of wood using a hand operated chain saw. And the cylindrical pieces of wood are typically split via a hand operated wood splitter maul or axe.

One way that wood may be split into smaller pieces involves using a motor driven log splitter in place of the hand operated wood splitter maul or axe. These motor driven log splitters are well known in the art are typically portable stand-alone devices that include a frame having wheels that allow the splitter to be transported to various locations as desired. The splitter typically includes a cradle, a backstop and a splitter wedge connected to a hydraulic piston, where the cradle supports the log to be split and the backstop and splitter wedge are located on opposite ends of the cradle. When the splitter is operated, the hydraulic piston causes the splitter wedge to move within the cradle and toward the backstop. This compresses the splitter wedge against one end of the log to be split and the other end of the log to be split against the backstop. The wedge shape of the splitter wedge causes the log to be split.

Unfortunately however, although using a log splitter is faster, safer and less labor intensive than using a maul or axe to split wood, a significant amount of time is wasted in the set up and arrangement of the log splitter and the wood to be split. This is because the wood to be split needs to be located proximate the log splitter (or vise versa). Each piece of wood then needs to be lifted and put into the cradle of the log splitter and the splitter must be operated, the area cleared and the splitter reloaded with wood.

SUMMARY OF THE INVENTION

In one embodiment of the invention, a log splitter is provided, wherein the log splitter includes a splitter housing, wherein the splitter housing defines a housing cavity, a splitter head, wherein the splitter head includes a splitter blade, a splitter butt plate and a splitter hydraulic cylinder, wherein the splitter head and splitter butt plate are configured to define a log cavity between the splitter blade and the splitter butt plate and wherein the splitter head is movably associated with the splitter housing and connected to the splitter hydraulic cylinder, such that the splitter head is movable along the length of the splitter housing, wherein the log cavity is reduced in size to cause the splitter blade to compress against a log contained within the log cavity.

BRIEF DESCRIPTION OF THE DRAWINGS

The foregoing and other features and advantages of the present invention will be more fully understood from the following detailed description of illustrative embodiments, taken in conjunction with the accompanying drawings in which like elements are numbered alike.

DETAILED DESCRIPTION OF THE INVENTION

Figure 1:
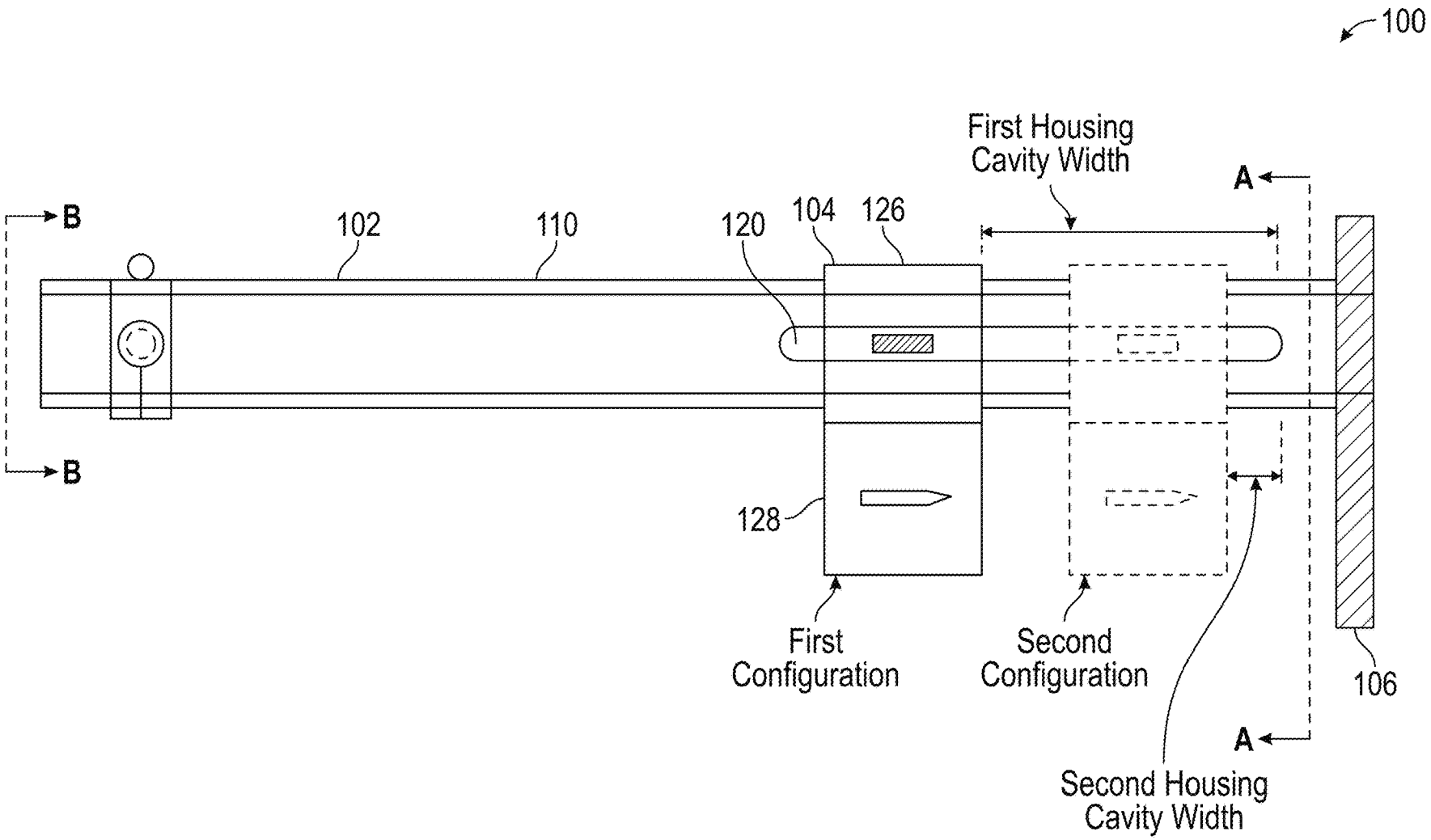
FIG. 1 is a side view of a log splitter, in accordance with one embodiment of the invention.
Figure 2:
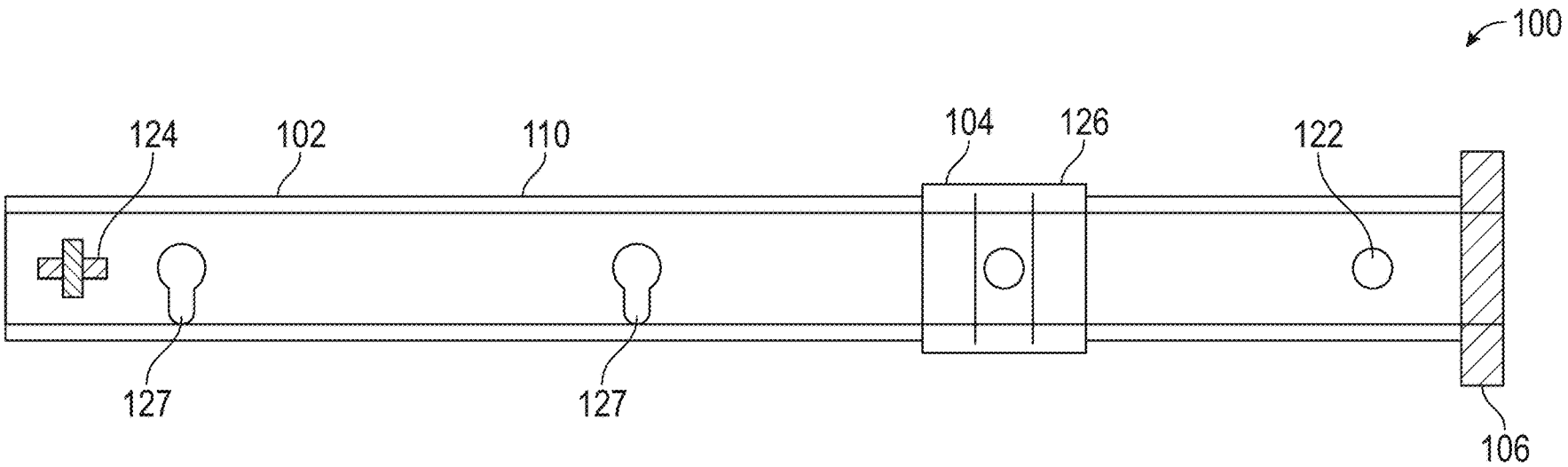
FIG. 2 is a top down view of the log splitter of FIG. 1.
Figure 3A:
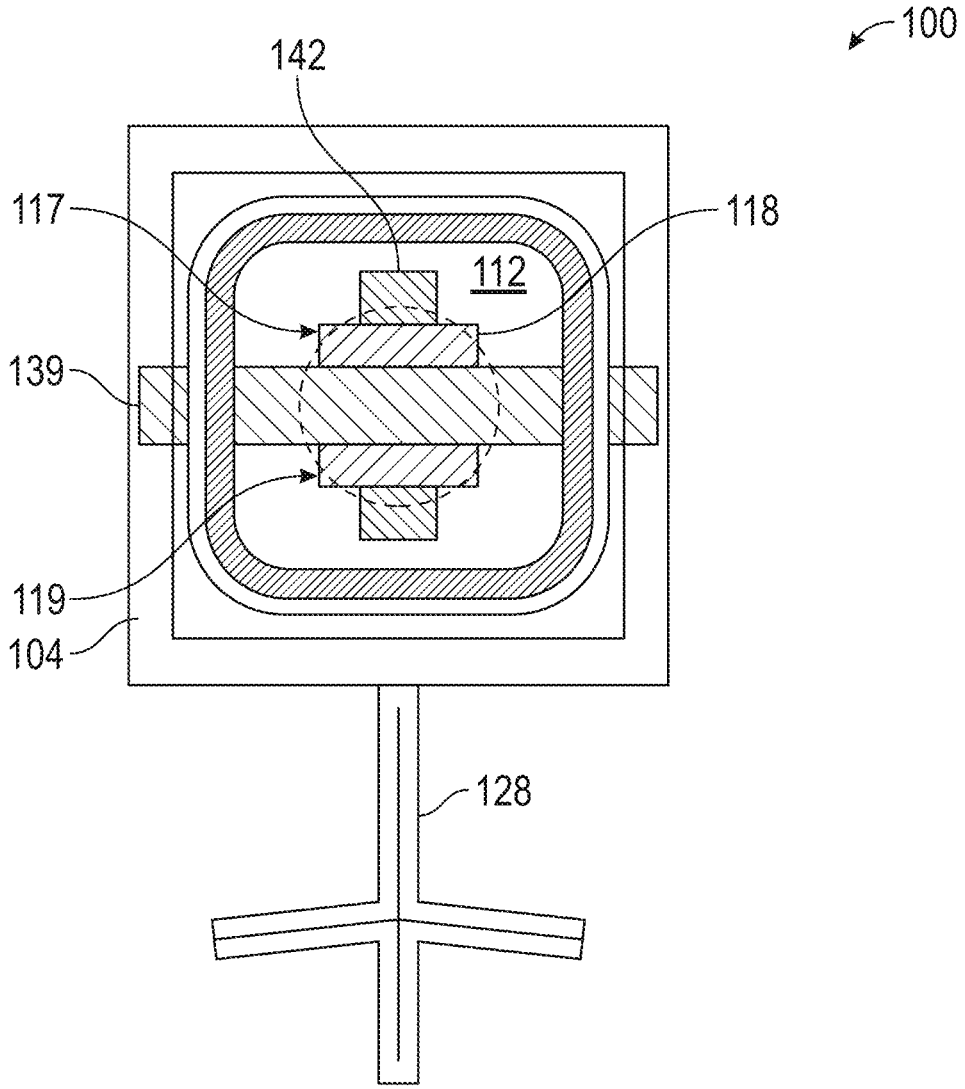
FIG. 3A is a front view of the log splitter of FIG. 1.
Figure 3B:
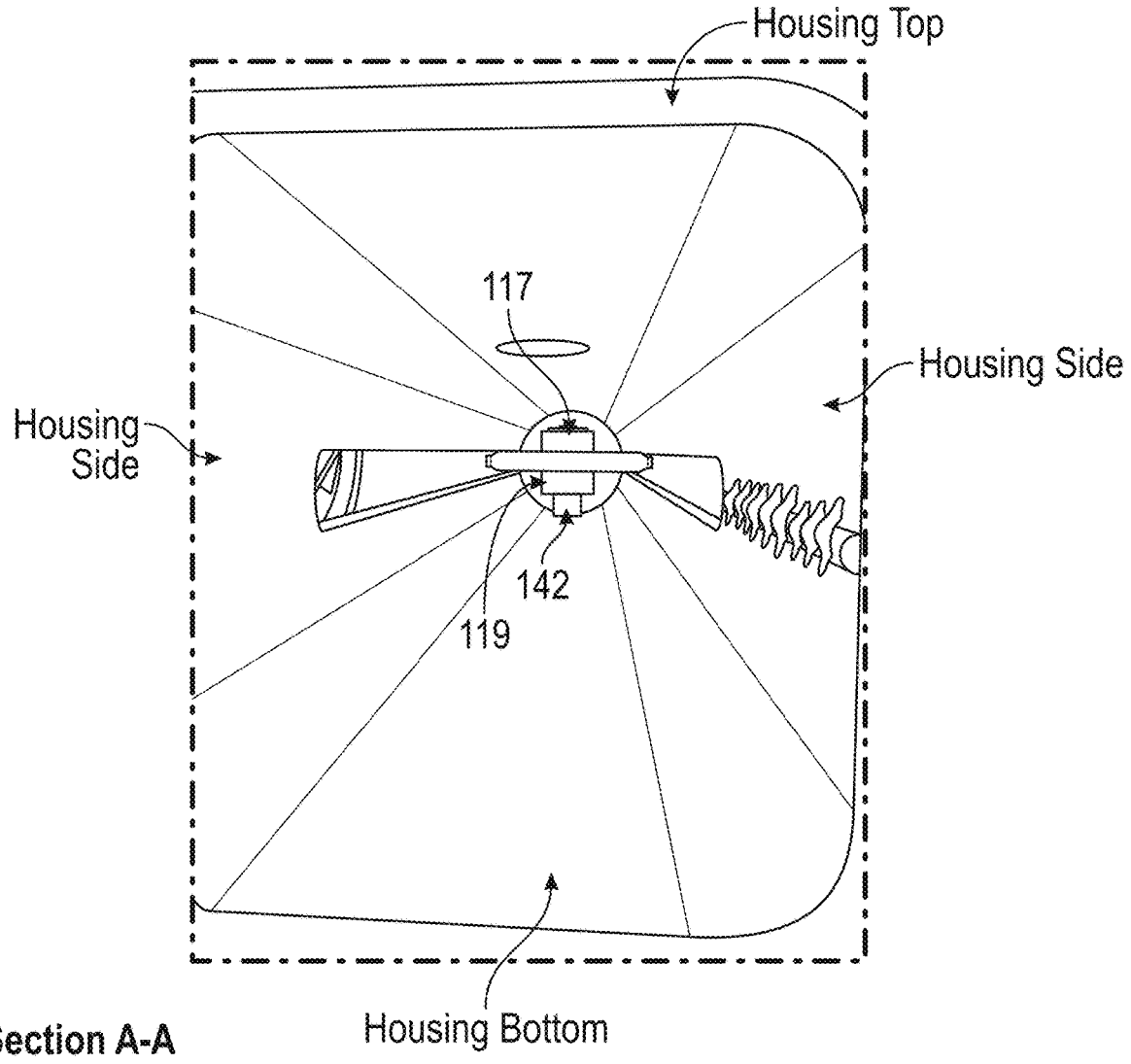
FIG. 3B is a front view of the log splitter of FIG. 1.
Figure 3C:
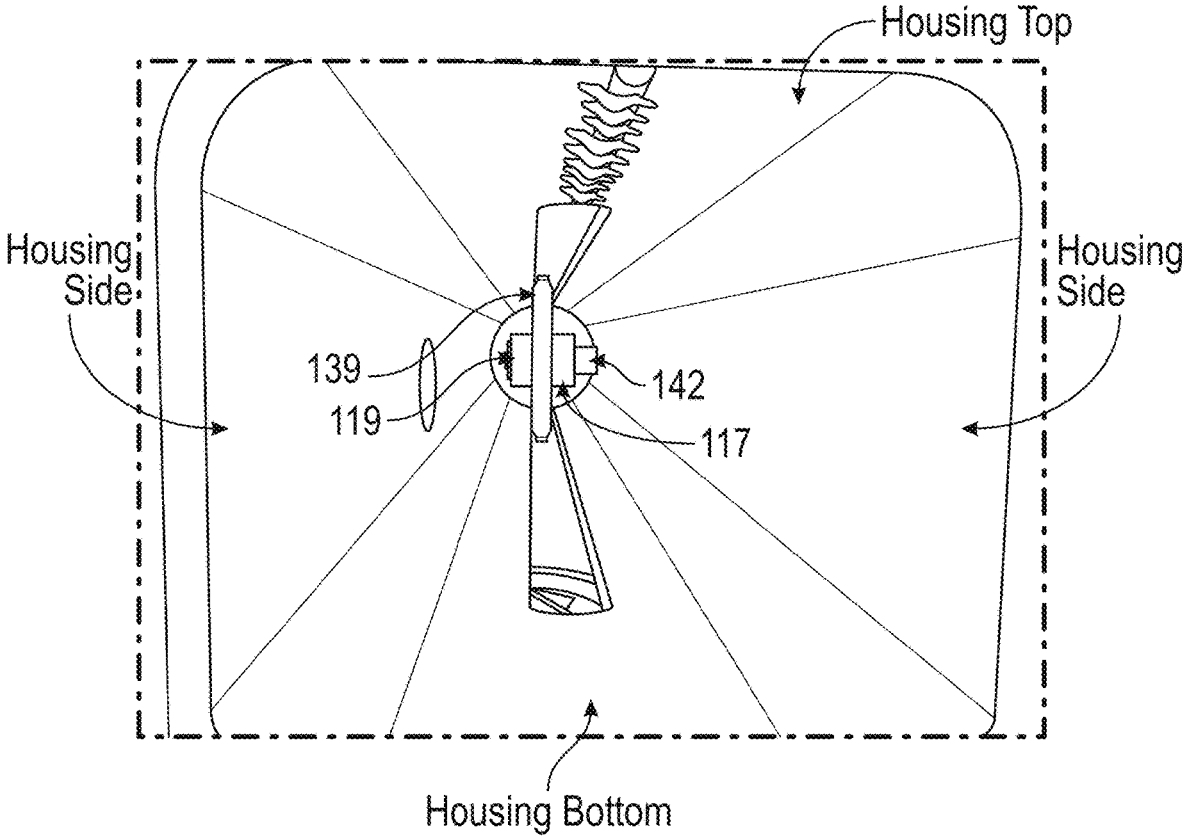
FIG. 3C is a front view of the log splitter, in accordance with another embodiment.
Figure 4A:
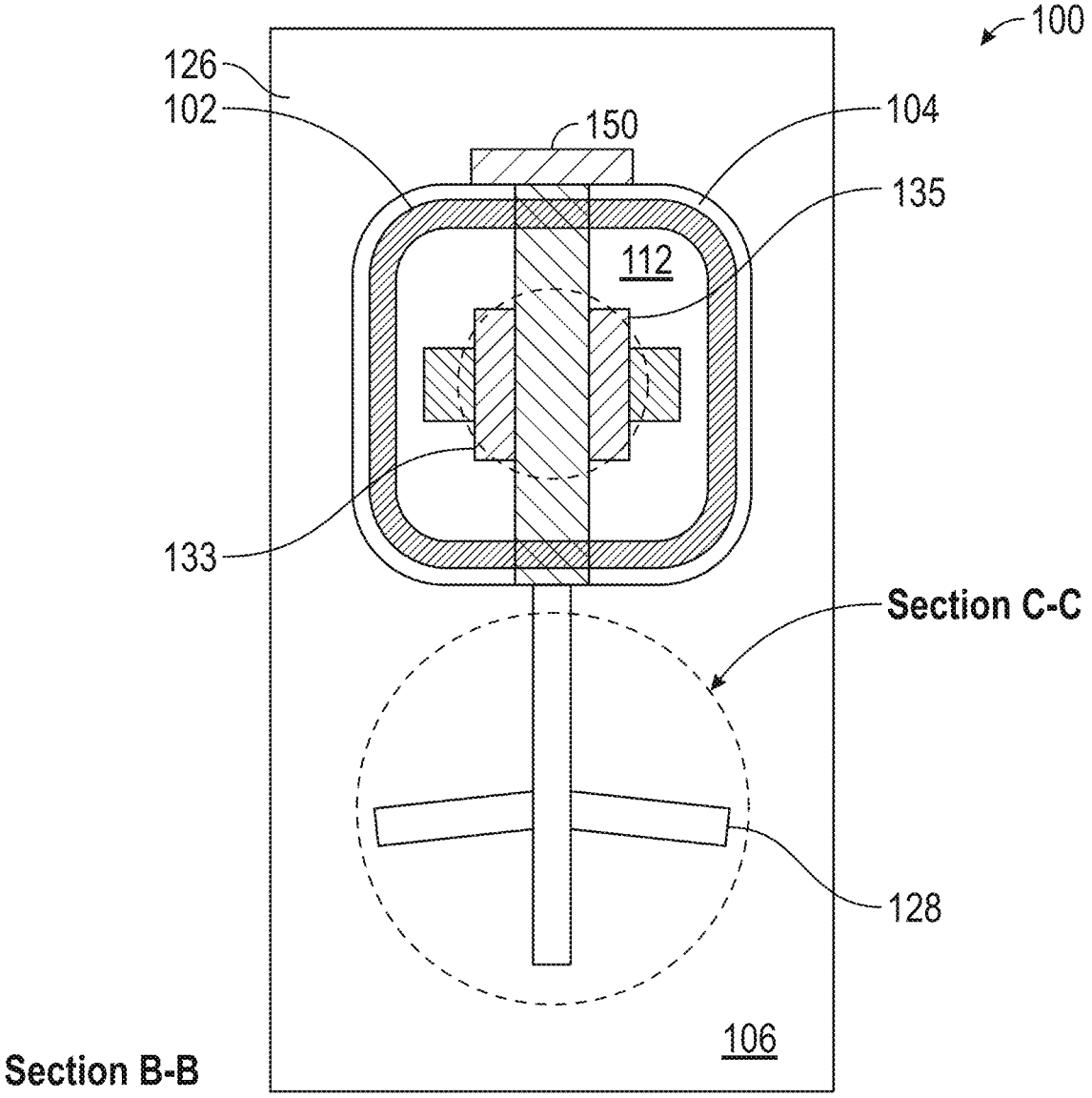
FIG. 4A is a rear view of the log splitter of FIG. 1.
Figure 4B:
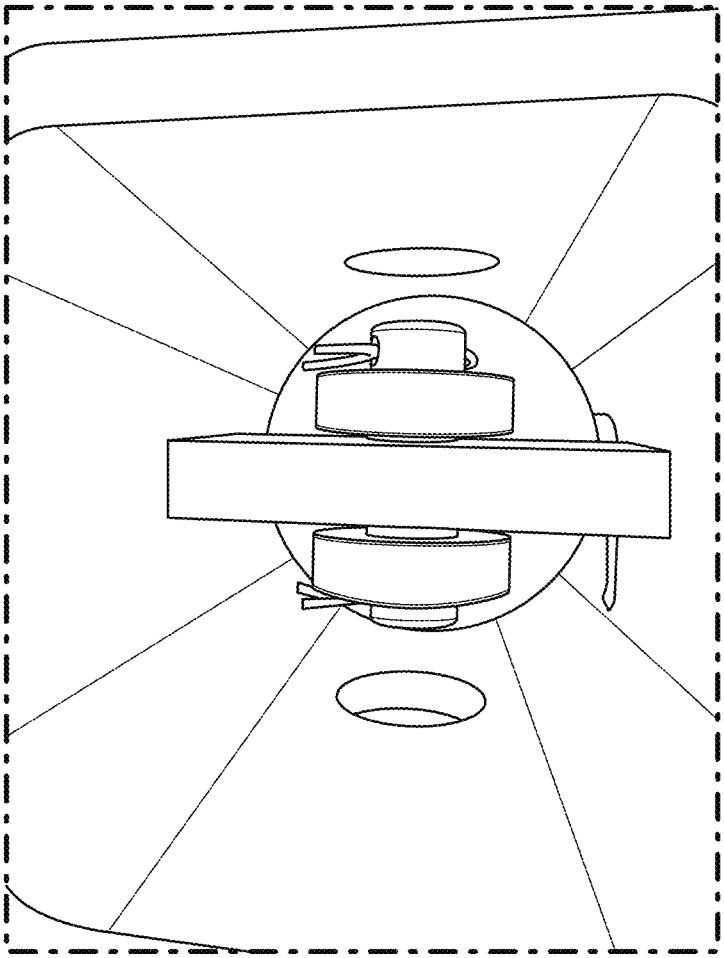
FIG. 4B is a rear view of the log splitter of FIG. 1.
Figure 5:
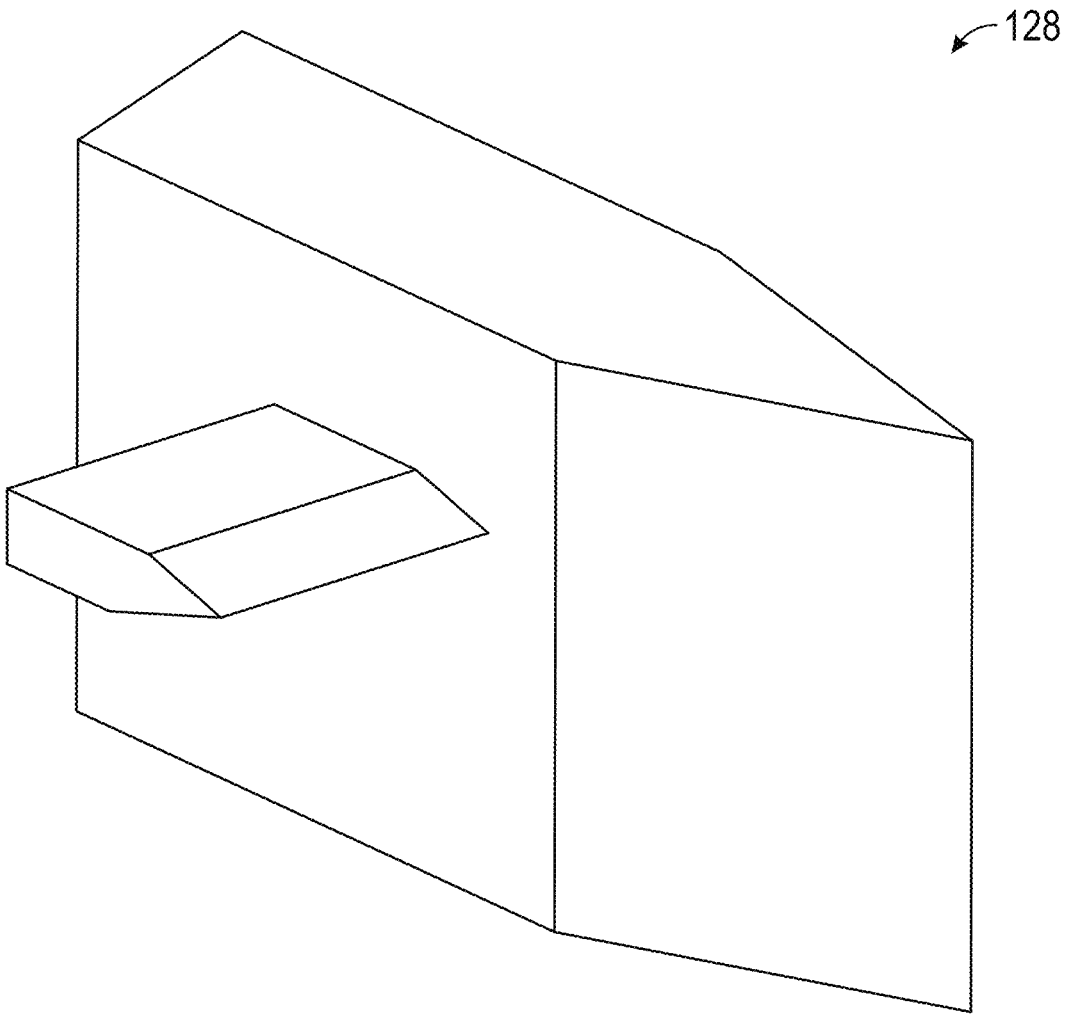
FIG. 5 is a side perspective view of the head blade structure of the log splitter of FIG. 1.
Figure 6:
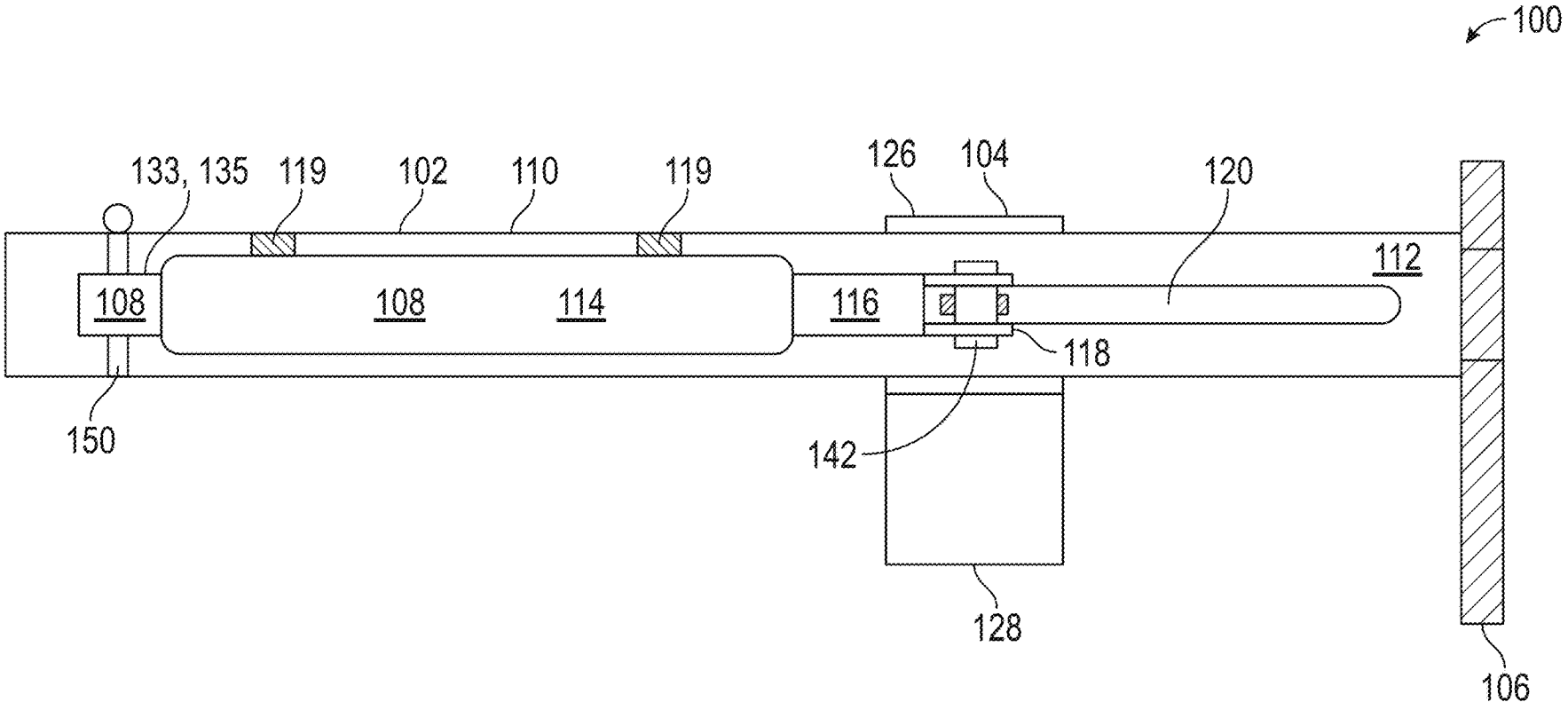
FIG. 6 is a side sectional view of the log splitter of FIG. 1.
Figure 7:
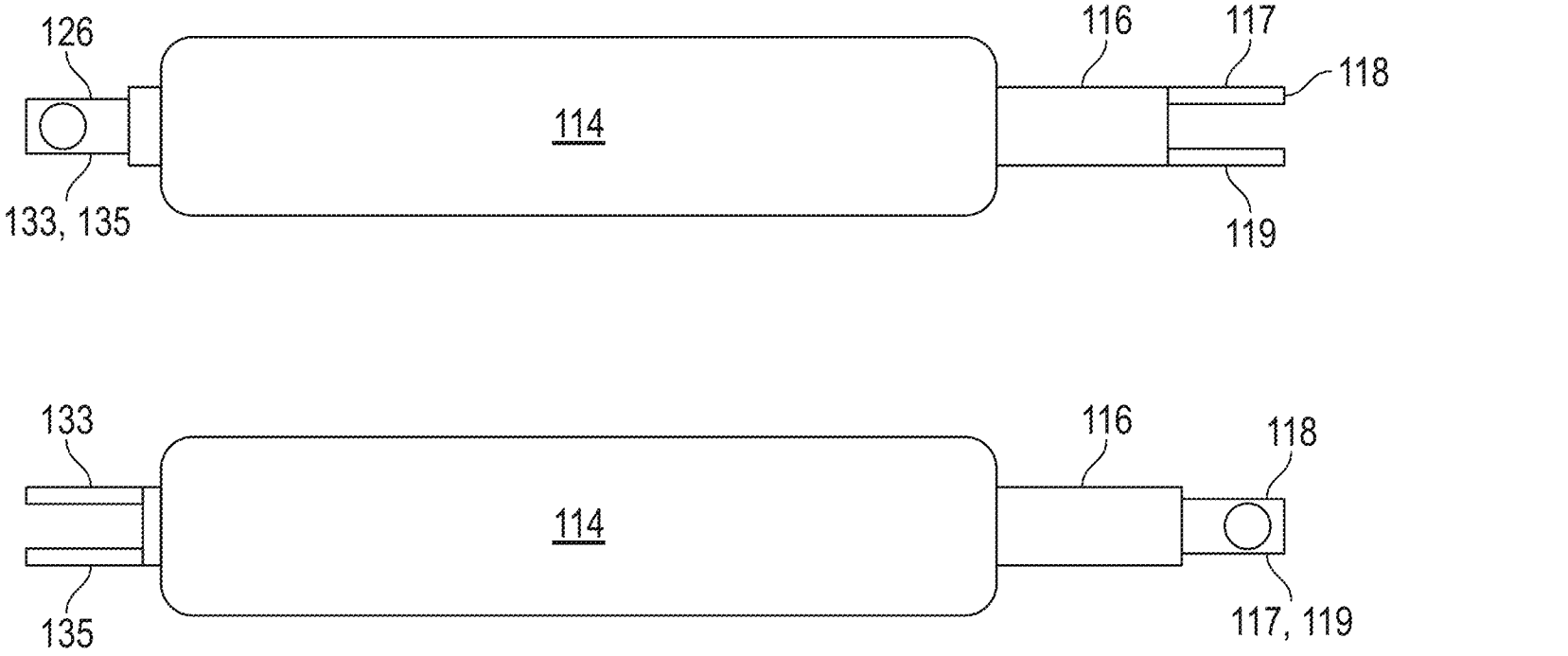
FIG. 7 is a top down and bottom up view of the hydraulic cylinder for use with the log splitter of FIG. 1.
Figure 8:
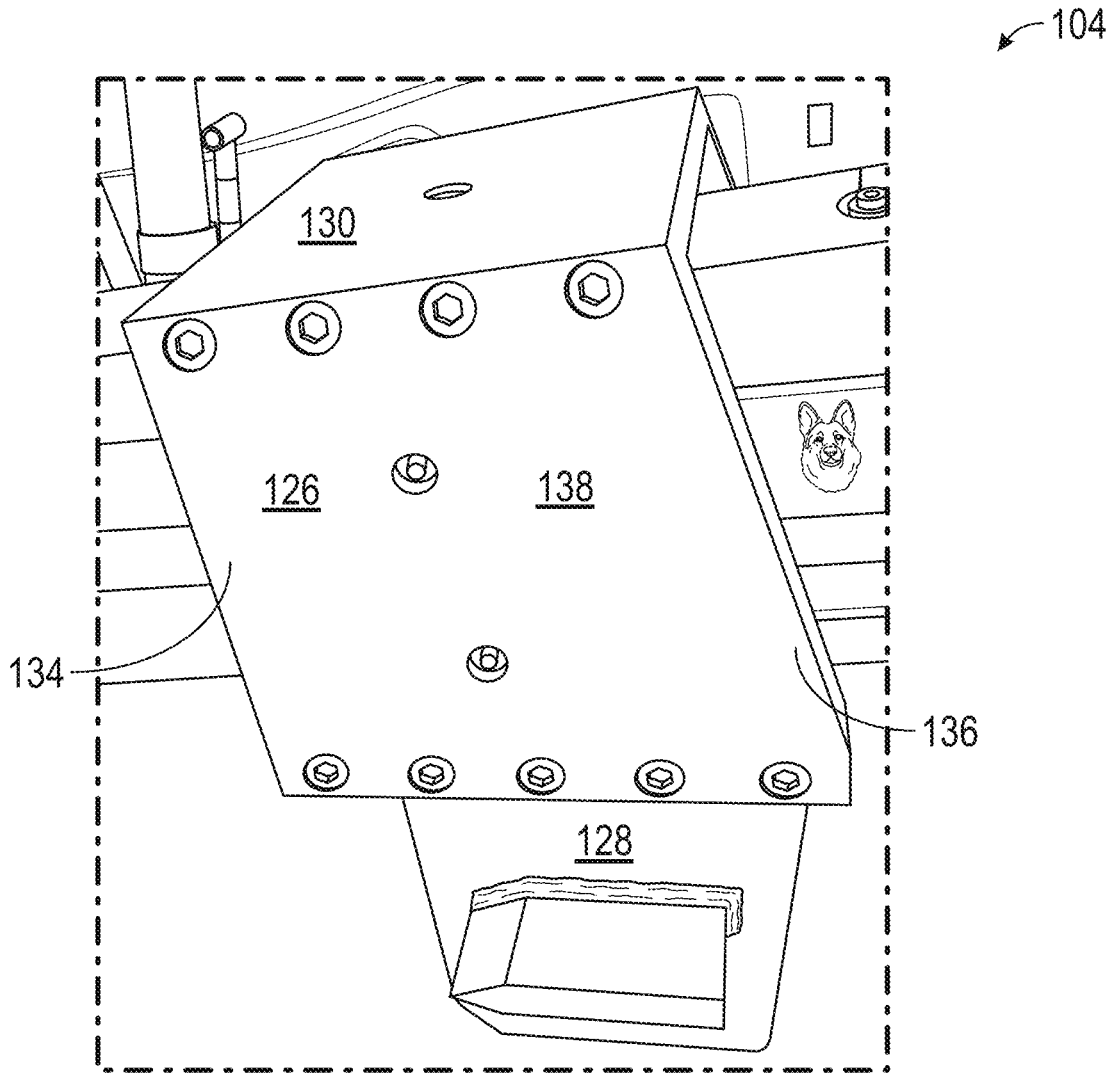
FIG. 8 is a side view of the splitter head of the log splitter of FIG. 1.
Figure 9:
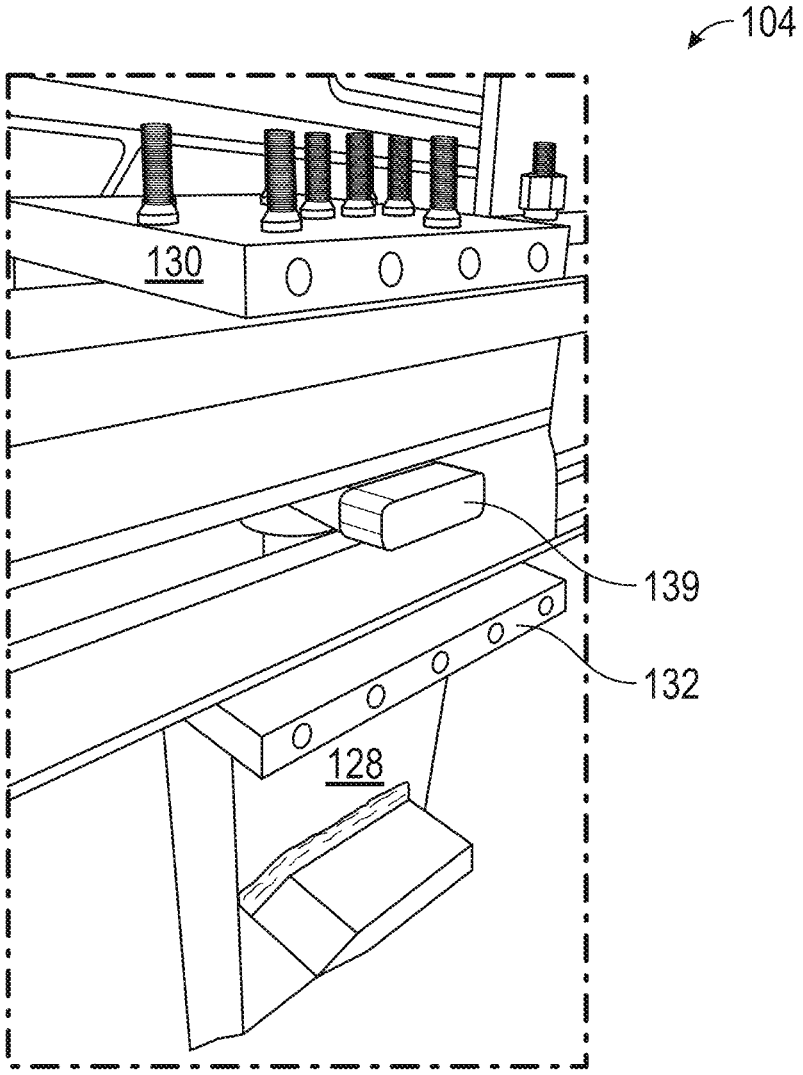
FIG. 9 is a side view of the splitter head of the log splitter of FIG. 1, with one of the plurality of sides dismantled.
Figure 10:
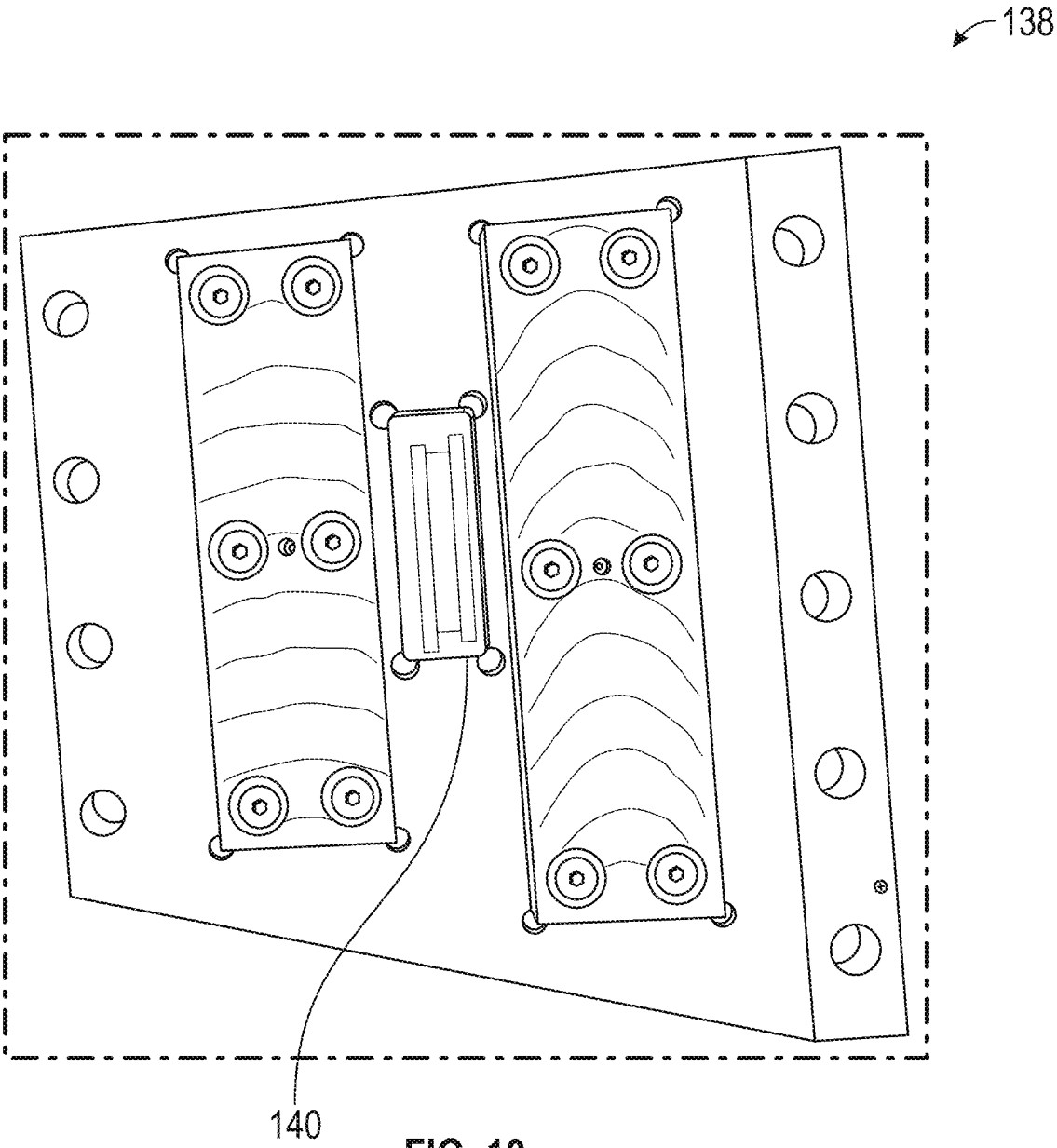
FIG. 10 is a side view of the inner surface of one of the plurality of sides of the splitter head of FIG. 7.
Figure 11:
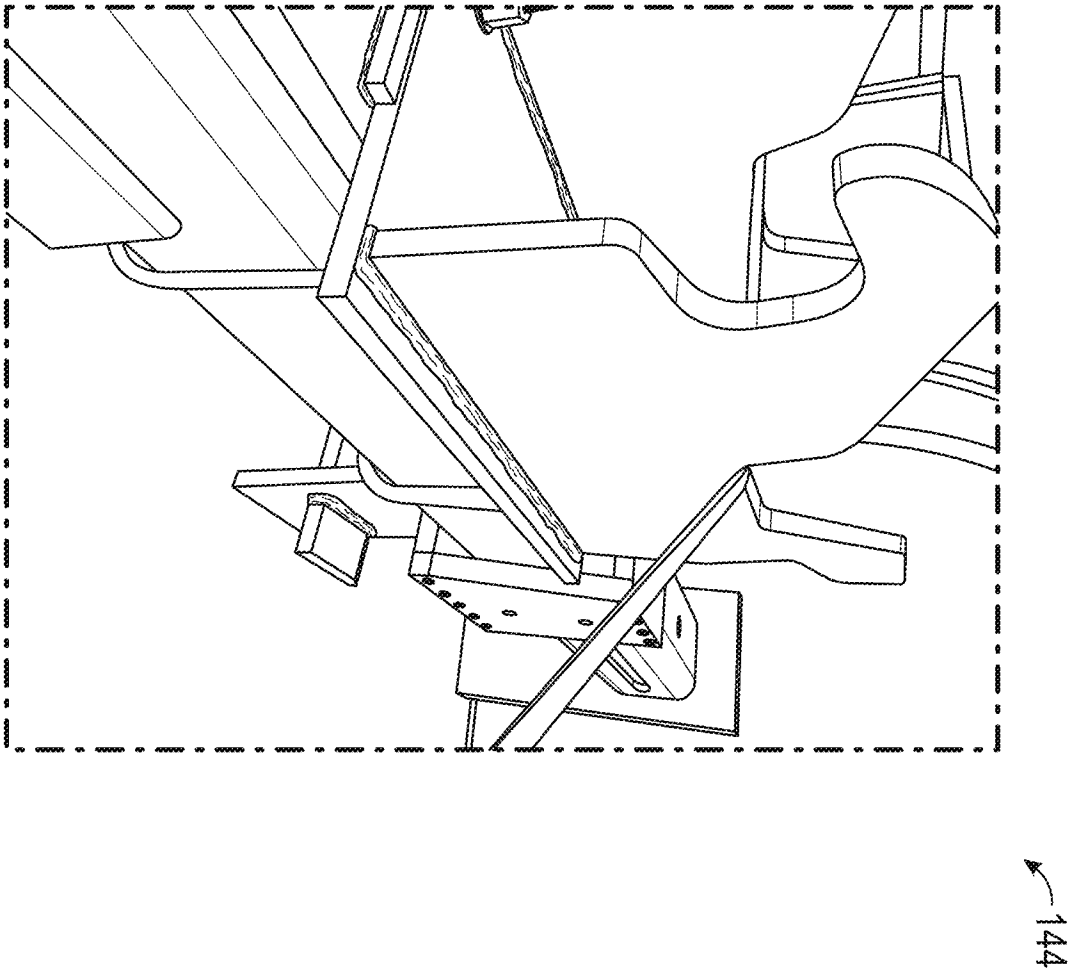
FIG. 11 is a rear side perspective view of the connector article used to securely connect the splitter housing of the log splitter of FIG. 1 to a quick coupler of an excavator, backhoe or other construction machine.
Figure 12:
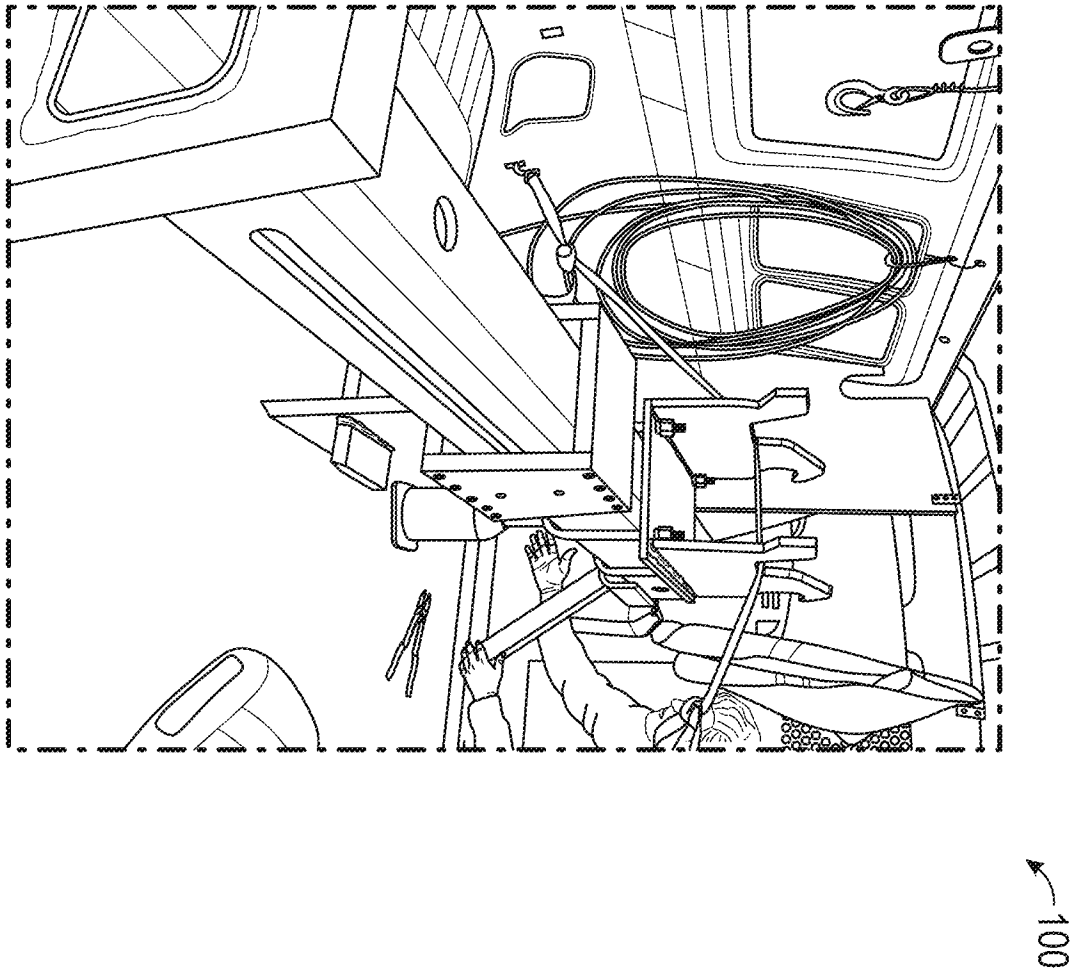
FIG. 12 is a front side perspective view of the log splitter of FIG. 1.
Figure 13:
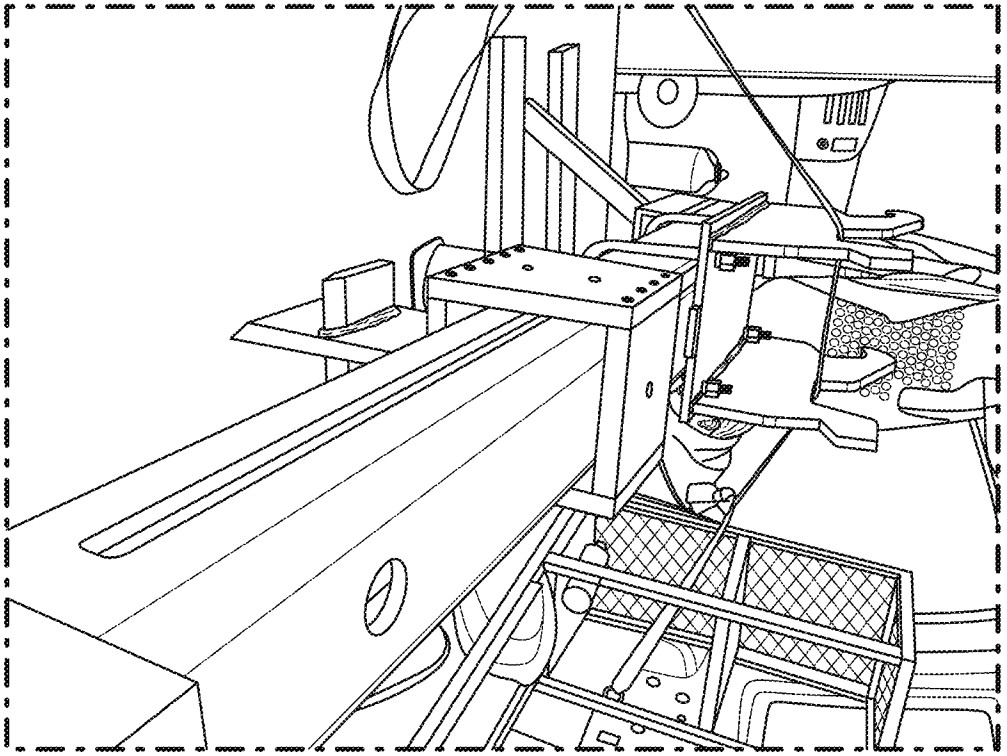
FIG. 13 is a front side perspective view of the log splitter of FIG. 1.

Referring to the FIG. 1-13, a log splitter 100 is provided in accordance with an exemplary embodiment and includes a splitter housing 102, a splitter head 104, a splitter butt plate 106 and a splitter hydraulic cylinder 108, wherein the splitter butt plate 106 is located on end of the splitter housing 102 and extends below the splitter housing 102 to act as a buttress for the wood being split. The splitter housing 102 includes a housing outer structure 110 which defines a housing cavity 112 for containing the splitter hydraulic cylinder 108. The splitter hydraulic cylinder 108 includes a cylinder housing 114 and a hydraulic piston 116 having a piston end 118, where the cylinder housing 114 includes a plurality of fluid fittings 119 and is configured to connect with the hydraulic system of an excavator, backhoe or other construction device such that the splitter hydraulic cylinder 108 may be controlled by the excavator, backhoe or other device. The splitter hydraulic cylinder 108 is controllable to cause the hydraulic piston 116 to be movable between a first configuration and a second configuration. It should be appreciated that when in the first configuration, the hydraulic piston 116 is retracted into the cylinder housing 114 such that the hydraulic piston end 118 is located proximate the cylinder housing 114 and when in the second configuration, the hydraulic piston 116 extends from the cylinder housing 114 such that the hydraulic piston end 118 is located proximate the splitter butt plate 106.

The splitter housing 102 defines coupler openings or slots 120 located on opposing sides of the splitter housing 102, wherein the coupler openings 120 extend along at least a portion of the length of the splitter housing 102. Additionally, the splitter housing 102 further defines a first mounting opening 122 and a second mounting opening 124, wherein the first mounting opening 122 is located proximate the splitter butt plate 106 and is used for access to the housing cavity 112 to connect the splitter head 104 to the splitter hydraulic cylinder 108 and wherein the second mounting opening 124 is located proximate the splitter hydraulic cylinder 108 and is used for access to the housing cavity 112 to connect the splitter hydraulic cylinder 108 to the splitter housing 102.

The splitter head 104 includes a head mounting structure 126 and a head blade structure 128 having at least one blade for splitting wood. The head mounting structure 126 includes a structure top 130, a structure bottom 132, a structure front 134, a structure rear 136 and a plurality of structure sides 138, wherein the inner surface of the plurality of structure sides 138 include a dowel cavity 140. The splitter head 104 also includes a dowel 142 for securely associating the head mounting structure 126 with the splitter hydraulic cylinder 108. Furthermore, the head blade structure 128 is securely attached to the structure bottom 132 of the head mounting structure 126. Additionally, the log splitter 100 includes a connector article 144 which is securely connected to the splitter housing 102 and which is configured to securely connect to a quick coupler of an excavator, backhoe or other machine.

In accordance with one embodiment of the invention, one end of the splitter hydraulic cylinder 108 is securely associated with the splitter housing 102 to be located within the housing cavity 112. This is accomplished as shown in the FIG.s, wherein the rear of the splitter hydraulic cylinder 108 includes a C-shaped structure (i.e. double clevis) having a first end leg 133 and a second end leg 135 and includes mounting holes in each of the first and second end legs 133, 135. This allows the splitter hydraulic cylinder 108 to be connected to the splitter housing 102 via a mounting pin 150 and a dowel-cotter pin arrangement. It should be appreciated that the mounting pin 150 may be accessible via the second mounting opening 124 and the dowel-cotter pins may be accessible via openings in the side of the splitter housing 102. Once the splitter hydraulic cylinder 108 securely associated with the splitter housing 102, the hydraulic piston 116 is configured into the second configuration such that the hydraulic piston end 118 is located proximate the splitter butt plate 106 and proximate the first mounting opening 122. The structure top 130 and one of the plurality of side structures 138 of the head mounting structure 126 is removed and the head mounting structure 126 is located over the splitter housing 102 to be proximate the first mounting opening 122.

A mounting article or coupler 139 (such as a piece of flatstock) having an article hole is inserted into one of the coupler openings 120 such that one end of the mounting article 139 is located within the dowel cavity 140 of the structure side 138 that was not removed. Additionally, the hydraulic piston end 118 is configured as a C-shaped structure (i.e. double clevis) having a first end leg 117 and a second end leg 119 and includes piston holes in each of the first and second end legs 117, 119. The hydraulic piston end 118 is positioned such that the mounting article 139 is located between the structure legs of the hydraulic piston end 118. The mounting or dowel pin 142 is then associated with the structure legs of the hydraulic piston end 118 and the mounting article 139 by locating the dowel pin 142 within the article hole of the mounting article 139 and the piston holes in each of the structure legs of the hydraulic piston end 118. If desired, a cotter pin may be used to help secure the dowel pin in place. At this point the structure top 130 and the side structure 138 is reconnected to the head mounting structure 126. It should be appreciated that when the side structure 138 is reconnected to the head mounting structure 126, the other end of the mounting article is located within the dowel cavity 140 of the side structure 138. This arrangement advantageously allows the ends of the mounting article 139 to extend from the coupler openings 120 such that the coupler openings 120 act as a stabilizer and guide to the hydraulic piston 116 as the hydraulic piston 116 is configured between the first configuration and the second configuration.

It should be appreciated that in another embodiment, the head mounting structure 126 may be a square (or cubed) shape. Additionally, although the coupler openings 120 are shown as being located on the sides of the splitter housing 102, in other embodiments the coupler openings 120 may be located on the top and bottom of the splitter housing 102. As such, the arrangement of the hydraulic piston end 118 may be oriented such that the first end leg 117 and second end leg 119 are positioned to be vertically oriented (See FIG. 3C). It should be appreciated that this orientation advantageously reduces stress wear and tear to the coupler openings 120 in the transverse plane.

It should be appreciated that one of the unique and novel characteristics of the present invention is the single tube (i.e. splitting housing 102) arrangement with the coupler 139 and coupler openings 120. This arrangement advantageously allows for an efficient transfer of force from the internal components (i.e. splitter hydraulic cylinder 108) to the head blade structure 128 via the coupler 139 and coupler openings 120. Accordingly, it is contemplated that the splitter housing and/or the arrangement of the splitter housing may be used in applications other than log splitting, such as, for example, jack/lift applications and press applications.

In accordance with one embodiment of the invention, one embodiment of a method for operating the log splitter 100 is described as follows. The log splitter 100, arranged as above, is physically connected to a boom of an excavator, backhoe or other machine with hydraulic controls by securely associating the connector article 144 with a quick coupler located on the boom of the excavator, backhoe or other machine. The hydraulic hoses from the excavator, backhoe or other machine are connected to the plurality of fluid fittings 119 (which are accessible via the fitting openings 127) of the splitter hydraulic cylinder 108 such that the splitter hydraulic cylinder 108 is controllable via the hydraulic controls of the excavator, backhoe or other machine. The excavator, backhoe or other machine is operated such that the log splitter 100 is located over a log to be split, wherein the log is located between the head blade structure 128 and the butt plate 106. The splitter hydraulic cylinder 108 is operated to cause the hydraulic piston 116 to be configured into the second configuration such that the log to be split is compressed between the head blade structure 128 and the butt plate 106. The boom of the excavator, backhoe or other machine is raised such that the log is located above the ground to be substantially parallel with the ground. A chainsaw (or other cutting device) is used to cut the log into 2-4 foot sections which are allowed to drop to the ground.

The excavator, backhoe or other machine is operated such that one of the 2-4 foot section of wood is located within the space between the head blade structure 128 and the butt plate 106, wherein the 2-4 foot section of wood is substantially parallel with the splitter housing 102. The log splitter 100 is then operated to configure the hydraulic piston 116 from the first configuration into the second configuration such that the 2-4 foot section of wood is compressed between the head blade structure 128 and the butt plate 106, wherein one end of the 2-4 foot section of wood is in contact with the head blade structure 128 and the other end of the 2-4 foot section of wood is in contact with the butt plate 106. As the head blade structure 128 compresses against the end of the 2-4 foot section of wood, the four-blade design of the head blade structure 128 causes the 2-4 foot section of wood to be split into four wedge shaped pieces of wood. This process is repeated until the 2-4 foot sections of wood are split.

It should be appreciated that the splitter head 104 may be any shaped desired suitable to the desired end purpose. For example, in one embodiment (referring to FIG. 8), the shape of the splitter head may be trapezoidal (i.e. the bottom may be wider than the top. While in another embodiment, the shape of the splitter head may be square. While in still yet another embodiment the shape of the splitter head may be rectangular.

Figure 14:
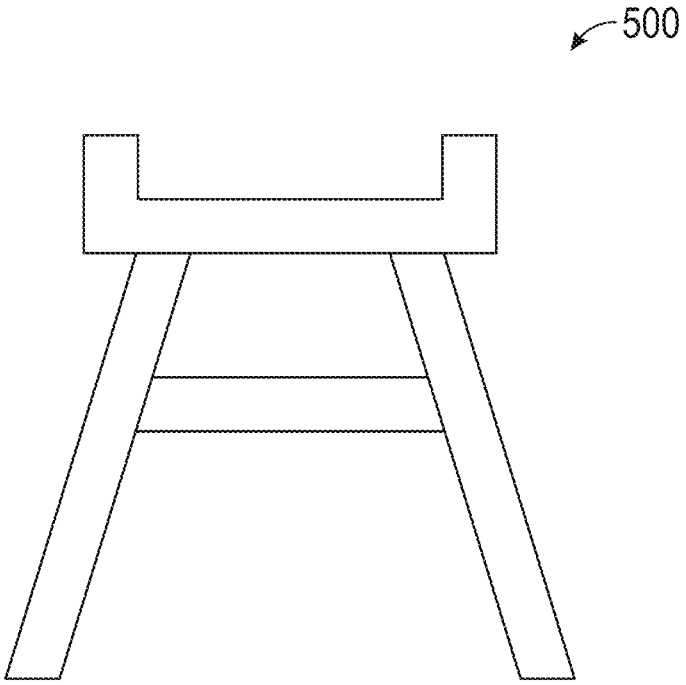
FIG. 14 is a front view of a log splitter support stand with use with the log splitter of FIG. 1, in accordance with one embodiment of the invention.
Figure 15:
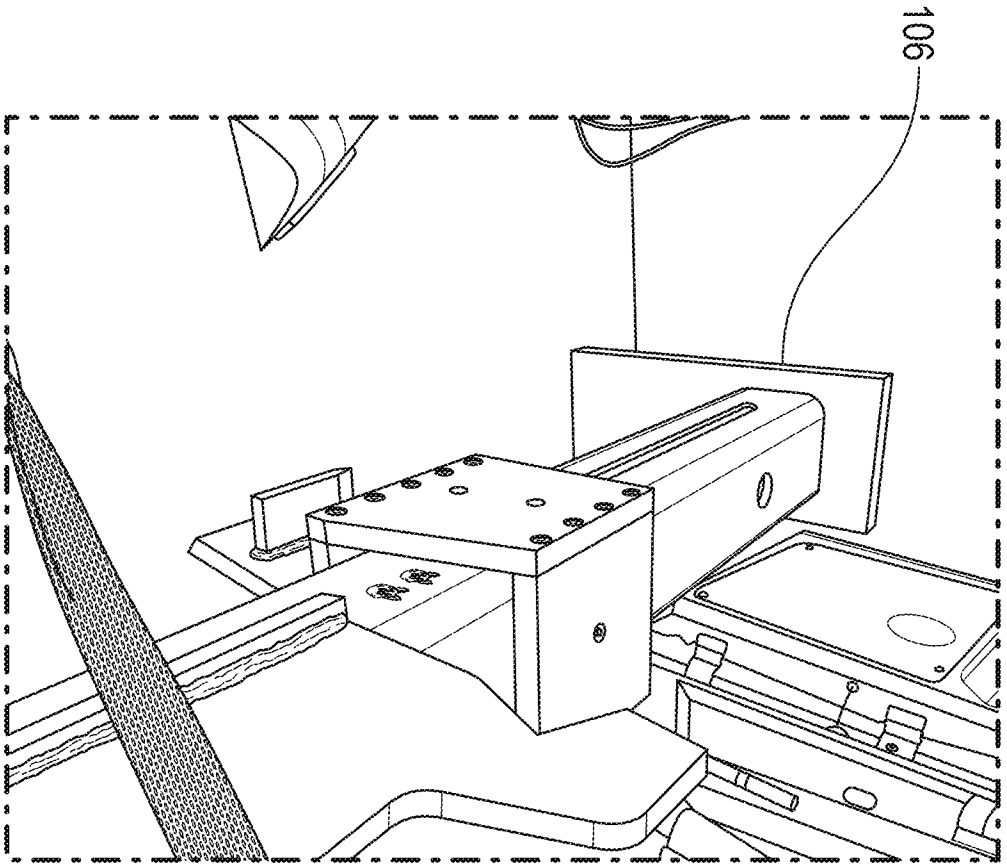
FIG. 15 is a rear side perspective view of the log splitter of FIG. 1 showing the butt plate extending downward from the splitter housing to support the log splitter, in accordance with one embodiment of the invention.

It should be appreciated that although the log splitter 100 is disclosed herein as being operated in association with an excavator, backhoe or other machine, it is contemplated that the log splitter 100 may also be operated as a standalone article that may be configured in a horizontal or vertical configuration. In these embodiments, a log splitter support stand may be used to support and stabilize the log splitter 100. Referring to FIG. 14, one embodiment a log splitter support stand 500 is shown, wherein the log splitter support stand 500 may be configured to be securely connected to the log splitter (for example, to the log splitter housing 102 and/or splitter butt plate 106) or the log splitter support stand 500 may be configured such that the log splitter 100 simply rests on the log splitter support stand 500. In the present embodiment, the log splitter support stand 500 is configured to support one end of the log splitter housing 102 while the other end of the log splitter housing 102 is supported by the splitter butt plate 106 which extends downward from the log splitter housing 102 (See FIG. 15).

Moreover, additional information is provided in the attached appendix where the information does not and is not intended to limit the scope of the invention. Accordingly, all of the information contained herein may be combined together (individually or wholly) or taken singly to achieve varying embodiments of the invention and to add to the scope of the invention without limiting the invention to a particular embodiment.

While the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of any appended claims. Moreover, unless specifically stated any use of the terms first, second, etc. do not denote any order or importance, but rather the terms first, second, etc. are used to distinguish one element from another.

What is claimed is:

1. A log splitter, comprising:

a splitter housing, wherein the splitter housing is a single tube with a generally hollow interior and includes at least one coupler opening;

a connector article attached to the splitter housing, the connector article configured to removeably attach to a quick coupler located on a boom of an excavator or backhoe;

a splitter head located on the outside of the splitter housing, wherein the splitter head includes a splitter blade and a head mounting structure, wherein the head mounting structure is configured to completely surround the splitter housing, and the splitter blade generally extends downward from the splitter housing towards the ground, and the splitter head and splitter blade are configured to slide along the length of the splitter housing;

a coupler, wherein the coupler is associated with the splitter head and configured to extend through the at least one coupler opening to guide the splitter head along the splitter housing;

a splitter butt plate attached to one end of the splitter housing, and generally extends downward from the splitter housing towards the ground;

a splitter hydraulic cylinder located within the splitter housing;

wherein the splitter head and splitter butt plate are configured to define a log cavity between the splitter blade and the splitter butt plate, wherein the splitter head is connected to the splitter hydraulic cylinder;

a plurality of fluid fittings in operational communication with the splitter hydraulic cylinder, and configured to connect to a hydraulic system of the excavator or backhoe;

wherein when the connector article is attached to the boom of the excavator or backhoe and the plurality of fluid fittings are connected to the hydraulic system of the excavator or backhoe, an operator can operate the excavator or backhoe to move and operate the log splitter such that the log splitter can be moved to a log, and the log splitter can move the splitter head and blades with respect to the splitter butt plate so that the log splitter can pick up the log to split the log, or to hold the log in place while it is being cut with a chainsaw.

2. The log splitter of claim 1, wherein the splitter head is movably associated with the splitter housing to be configurable from a first configuration and a second configuration.

3. The log splitter of claim 2, wherein the housing cavity includes a first slot cavity width and a second slot cavity width, wherein the second slot cavity width is smaller than the first slot cavity width.

4. The log splitter of claim 3, wherein when the splitter head is configured from the first configuration into the second configuration, the log cavity is reduced in size to cause the splitter blade to compress against a log contained within the log cavity.

5. The log splitter of claim 1, further comprising a second splitter blade and a third splitter blade, the second splitter blade extending horizontally from a first side of the splitter blade, and the third splitter blade extending horizontally from a second side of the splitter blade.

6. A log splitter system comprising:

a hydraulic machine, the hydraulic machine comprising:
a boom with a quick coupler attached to the boom;

a log splitter removeably attachable to the hydraulic machine, the log splitter comprising:

a splitter housing, wherein the splitter housing is a single tube with a generally hollow interior and includes at least one coupler opening;

a connector article attached to the splitter housing, the connector article configured to removeably attach to the quick coupler;

a splitter head located on the outside of the splitter housing, wherein the splitter head includes a splitter blade and a head mounting structure, wherein the head mounting structure is configured to completely surround the splitter housing, and the splitter blade generally extends downward from the splitter housing towards the ground, and the splitter head and splitter blade are configured to slide along the length of the splitter housing;

a coupler, wherein the coupler is associated with the splitter head and configured to extend through the at least one coupler opening to guide the splitter head along the splitter housing;

a splitter butt plate attached to one end of the splitter housing, and generally extends downward from the splitter housing towards the ground;

a splitter hydraulic cylinder, wherein the splitter head and splitter butt plate are configured to define a log cavity between the splitter blade and the splitter butt plate and wherein the splitter head is movably associated with the splitter housing and connected to the splitter hydraulic cylinder, such that the splitter head is movable along the length of the splitter housing;

a plurality of fluid fittings in operational communication with the splitter hydraulic cylinder, and configured to connect to a hydraulic system of the hydraulic machine;

wherein when the log splitter is attached to the hydraulic machine, an operator can operate the hydraulic machine to move and operate the log splitter such that the log splitter can be moved to a log, and the log splitter can move the splitter head and blades with respect to the splitter butt plate so that the log splitter can pick up the log to split the log, or to hold the log in place while it is being cut with a chainsaw.

7. The log splitter system of claim 6, wherein the hydraulic machine is an excavator.

8. The log splitter system of claim 6, wherein the hydraulic machine is a back hoe.

* * * * *